United States Patent [19]

Metz

[11] 4,271,451

[45] Jun. 2, 1981

[54] METHOD AND APPARATUS FOR CONTROLLING STATIC CHARGES

[75] Inventor: Bruce E. Metz, Wilmington, Del.

[73] Assignee: Hercules Incorporated, Wilmington, Del.

[21] Appl. No.: 707,142

[22] Filed: Jul. 20, 1976

[51] Int. Cl.[3] ..... H01T 19/00

[52] U.S. Cl. ..... 361/213; 361/229; 361/235

[58] Field of Search ..... 361/212-214, 361/229, 230, 235; 250/324-326

[56] References Cited

U.S. PATENT DOCUMENTS

| | | | |
|---|---|---|---|
| 940429 | 11/1909 | Chapman | 361/225 X |
| 2,879,395 | 3/1959 | Walkup | 361/235 X |
| 3,037,149 | 5/1962 | Herbert, Jr. | 361/230 |
| 3,414,769 | 12/1968 | Hoffman | 361/235 |
| 3,475,652 | 10/1969 | Levy | 361/230 |
| 3,515,548 | 6/1970 | Lange | 361/235 X |
| 3,551,743 | 12/1970 | Koepke et al. | 361/230 |
| 3,619,719 | 11/1971 | Waller et al. | 361/230 |
| 3,643,128 | 2/1972 | Testone | 361/230 |
| 3,708,661 | 1/1973 | Hansen et al. | 361/230 X |
| 3,714,531 | 1/1973 | Takahashi | 361/230 |
| 3,716,754 | 2/1973 | Weber et al. | 361/213 |
| 3,730,753 | 5/1973 | Kerr | 430/30 |
| 3,757,163 | 9/1973 | Gibbons et al. | 361/230 |
| 3,775,104 | 11/1973 | Matsumoto et al. | 361/235 X |
| 3,787,706 | 1/1974 | DeGeest | 361/212 |
| 3,796,917 | 3/1974 | Hiller | 361/230 |
| 3,863,108 | 1/1975 | Blythe et al. | 361/212 |
| 3,921,037 | 11/1975 | Testone | 361/230 |
| 3,961,193 | 6/1976 | Hudson | 361/235 X |

FOREIGN PATENT DOCUMENTS

| | | | |
|---|---|---|---|
| 478292 | 11/1951 | Canada | 361/213 |

*Primary Examiner*—Harry E. Moose, Jr.
*Attorney, Agent, or Firm*—Joshua W. Martin, III; Stanley A. Becker

[57] ABSTRACT

Method and apparatus for controlling static charges on dielectric material by producing an ionized field and controlling the balance and magnitude of the directional conductivity of the ionized field. The directional conductivity characteristics are typically controlled by applying a DC bias of selected polarity and magnitude to a high voltage AC output which is applied to an ionizing member to produce the ionized field.

1 Claim, 11 Drawing Figures

METHOD AND APPARATUS FOR CONTROLLING STATIC CHARGES

BACKGROUND OF THE INVENTION

This invention relates to a method and apparatus for controlling static charges and particularly to a method and apparatus for producing an ionized field and controlling the balance and magnitude of the directional conductivity of the field in order to control static on film and other dielectric material.

It has been found that when using conventional static control devices, low level static charges appear to be left on films or other dielectric material. These low level charges were frequently responsible for subsequent processing problems, which may or may not have been recognized as being caused by static electricity. For example, in applications wherein particulate materials, such as coffee, are being packaged in a plastic bag, the application of high voltage AC for ionization purposes to reduce static charges on the plastic film imparts a negative charge to the film which attracts the particulate materials which usually have a positive charge. Accordingly, in such packaging applications, there is a tendency for the particulate materials to adhere to the film after the film passes by a static control device, thereby adversely affecting the packaging operation by preventing the proper sealing of the film to form an enclosed bag.

In theory, dielectrics exposed to high voltage AC ionized gas fields would be expected to leave the field in a neutral condition since the areas under the positive and negative segments of the sinusoidal AC voltage wave form have an algebraic sum of zero. This should yield a neutral ionized field which exhibits equal conductivity in both directions. In practice, however, such ionized gas fields nearly always show directional conductivity which heretofore has not been easily controllable. Directional conductivity occurs when the ionized gas field conducts more in one direction than another. This can easily be measured by using commercially available equipment.

Additionally, in the processing of film or other dielectric material which is affected by static charges, undesirable static charges are frequently imparted to the film or other material as a result of passage past rollers or other parts of the processing equipment. Furthermore, because of space limitations, it is sometimes difficult to place conventional static control equipment at the location where static control is desired.

The present invention is directed to a method and apparatus for overcoming the foregoing problems to allow control of ion field balance and/or directional conductivity and permit management of the field's final effect with respect to processes involving ionized gas fields, such as static control applications.

SUMMARY OF THE INVENTION

The subject method and apparatus include facilities for producing an ionized field adjacent to a dielectric film or other material and for controlling the directional conductivity of the ionized field to impart a charge of predetermined magnitude and polarity to the film or material. The ionized field can be controlled in a number of ways, such as, by modifying an AC high voltage applied to a static control device or ionizing member to produce the ionized field, by modifying the ground reference, or by modifying the voltage or voltages applied to selected emitter points of the static control device. In this manner, the static charge level and polarity selection of the materials exposed to the static control device are adjustable at the operator's discretion. Thus, changes can be effected electrically to compensate for various conditions as opposed to having to mechanically change the design of the static control device to achieve different results, as has previously been done.

By appropriately controlling and/or balancing the directional conductivity of the ionized field, it is possible to eliminate the static charges on a moving film as it passes through the ionized field. Similarly, where it is desired for any reason to impart either a positive or negative charge to the film of any desired magnitude, such can easily be accomplished by appropriate control of the balance and/or control of the directional conductivity of the ionized field. For example, in a situation wherein film is being used to package coffee which usually has a positive charge thereon, it has been found desirable to impose a positive charge on the film so that during packaging the coffee particles are not attracted to the film and are, in fact, repelled, thereby avoiding any problem in the sealing of the coffee package caused by coffee adhering to the seal area.

Other advantages of the present invention will be apparent from the following detailed description of the invention when considered in conjunction with the following detailed drawings, which drawings form a part of the specification. It is to be noted that the drawings illustrate only typical embodiments of the invention and are therefore not to be considered limiting of its scope for the invention may admit to other equally effective embodiments.

DESCRIPTION OF THE INVENTION

Figure 1:
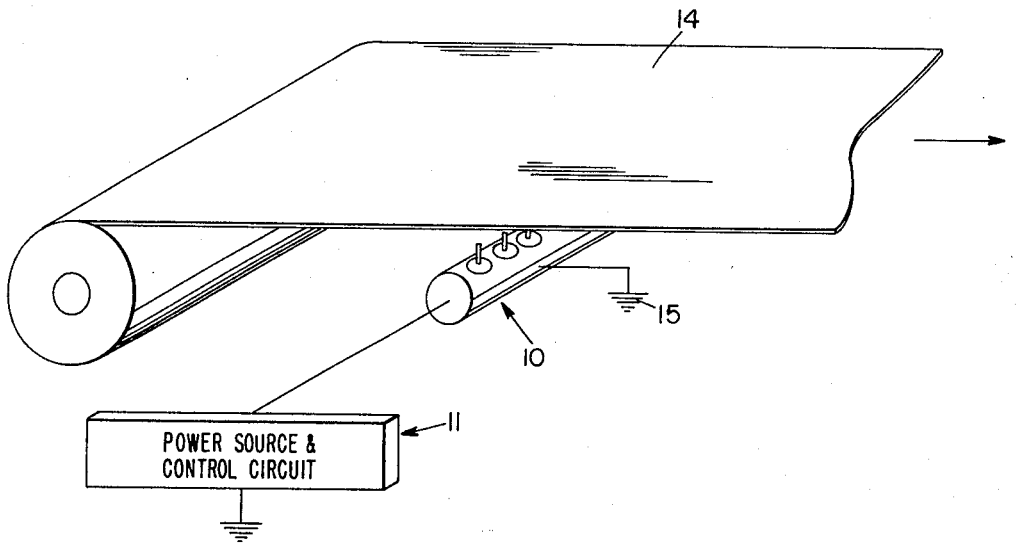
FIG. 1 is a partial perspective view illustrating a static control system embodying the principles of this invention for controlling static on a moving film.

Referring to FIG. 1, there is shown a conventional air or gas ionizer member 10 connected to a power source and control circuit generally designated as 11. The ionizer member 10, which may be of any desired shape, such as, for example, straight, curved or circular, is positioned adjacent to a moving dielectric film 14. An ionized field is produced by applying a high voltage from the power supply and control circuit 11 to the ionizer member 10 to control the static charges on the film 14. The power source and control circuit 11 controls the balance and magnitude of the directional conductivity of the ionized field in order to leave the film 14 in a desired condition with respect to its static characteristics. For example a desired condition may be a neutral condition wherein substantially all static charge is removed from the film. Another desired condition may be where the film 14 has a static charge remaining on the film of a predetermined magnitude and polarity. While reference is made herein to controlling static charges on film, it is to be understood that the principles of this invention are applicable to the control of static on any dielectric material in any form, such as, for example, fibers, polymer flake, paper, coffee or other particulate materials which can hold a static charge, and the like.

Figure 2:
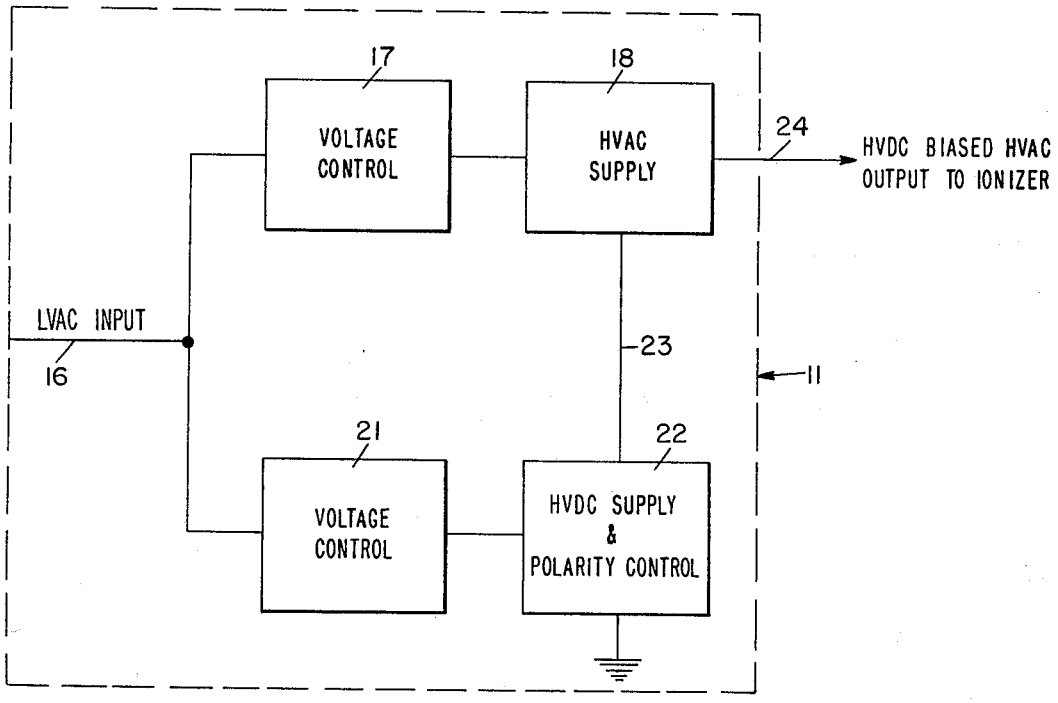
FIG. 2 is a block diagram illustrating one embodiment of the power source and control circuit of FIG. 1.

Referring now to FIG. 2, there is shown a block diagram of one embodiment of a power source and control circuit 11 including a line 16 which is connected to a low voltage AC source. The low voltage AC source is connected through a voltage control 17 to a high voltage AC supply 18 which is typically a step-up transformer. Adjustment of the voltage control 17 will control the intensity of the ionized field by increasing or decreasing the amplitude of the AC wave form. The low voltage AC input 16 is also connected to a voltage control 21 which is connected to a high voltage DC supply and polarity control 22 which typically is a step-up transformer connected through a rectifier circuit to supply a high voltage DC output on line 23 to the high voltage AC supply 18. The resultant output of the power source and control system 11 on line 24 is typically an AC wave form which can be selectively biased by the output 23 from the high voltage DC supply 22 to intentionally displace the neutral axis of the AC voltage wave form from a zero voltage reference.

Figure 3:
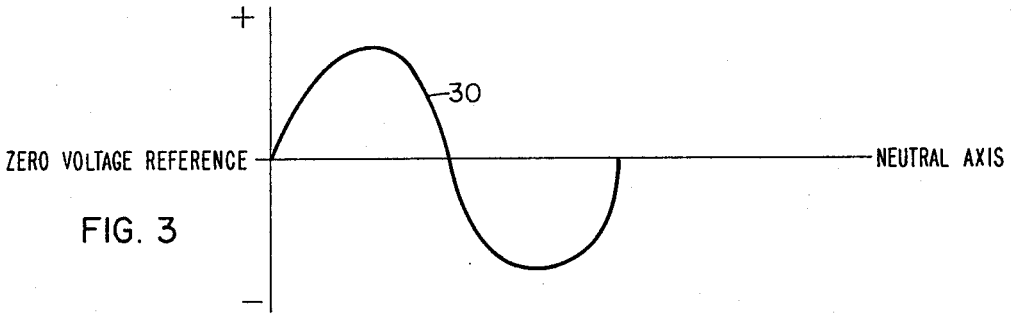
FIGS. 3–6 are wave form diagrams illustrating a normal AC wave form and various examples of modified wave forms which can be applied to an ionizer in accordance with the principles of this invention.
Figure 4:
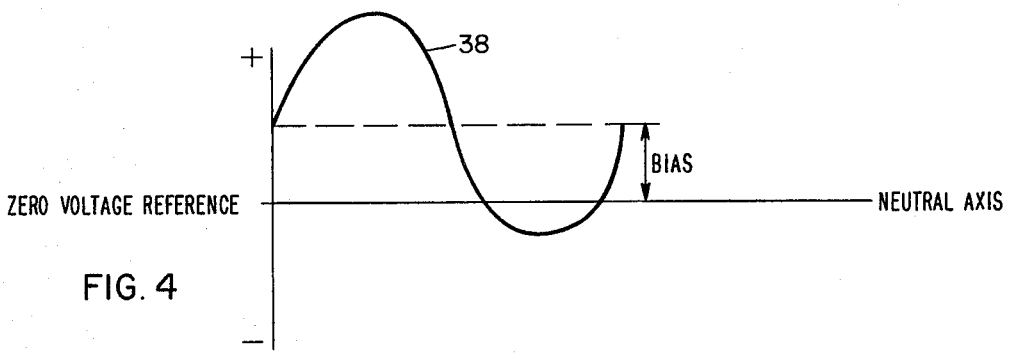
Figure 5:
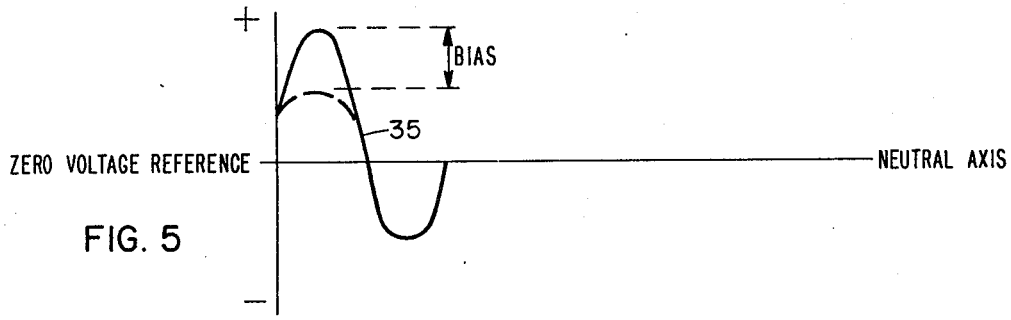
Figure 6:
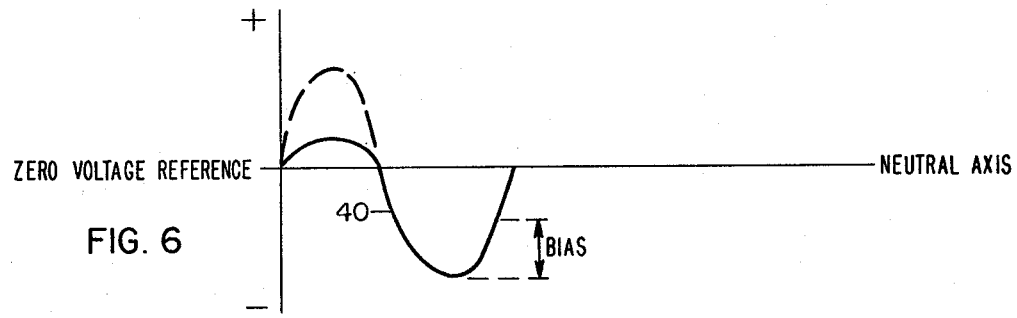

Referring now to FIG. 3, there is shown a conventional AC wave form 30 having its neutral axis coincide with the zero voltage reference line. In FIG. 4, there is shown a typical wave form output on line 24 wherein the AC wave form 38 is biased in a positive direction such that the neutral axis of the wave form no longer coincides with the zero voltage reference. Such a wave form 38 is produced by appropriate adjustment of the voltage and polarity control 21. Similarly, a wave form that is biased in the negative direction can be produced by adjustment of the voltage and polarity control 21. In FIG. 5 there is shown a typical wave form 35 which is modulated in a way which produces a positive ion field energy bias as shown. FIG. 6 discloses a typical wave form 40 which is modulated with a negative ion field energy bias.

It has been found that by adjustment of the energy balance of the wave form applied to the ionizer member, the balance and/or magnitude of the directional conductivity of the ionized field can be controlled. The energy balance of the wave forms shown in FIGS. 3–6 is the algebraic summation of the areas under the curve of each wave form. It is to be noted that any electrical circuit that will provide an output to an ionizer member having the desired energy balance can be utilized in practicing this invention, and that the circuits and block diagrams shown herein are for illustration purposes only and are not to be limiting of the scope of this invention. Furthermore, the invention is applicable for use with any conventional static control ionizer member having direct connected emitter pins and an appropriate grounding shield, and any power supply could be utilized to energize the ionizer providing (1) that the field be electrically excited, (2) that the applied electrical energy be of sufficient voltage to initiate and maintain an ionized condition in the gas field, (3) that an independent selected electrical voltage reference exists within the sphere of influence of the generated field (earth ground is frequently used as a zero voltage reference), and (4) that the energy balance of the wave form applied to the air ionizer be controlled as described to purposely change directional field balance and/or conductivity as desired.

It is to be noted that in ionization devices a certain threshold voltage, usually 1000 volts or more, must be applied before ionization takes place. Referring to FIG. 4, it can be seen that the peak to peak voltage necessary for ionization stays the same while allowing the ion field energy summation to be changed by very small increments caused by the magnitude and polarity of the DC bias applied to the AC voltage. Consequently, very fine control of the magnitude and polarity of the ionized field is possible. Referring again to FIG. 4, it can be seen that when the AC wave form is biased entirely above the zero voltage reference, the resultant output is basically a pulsating DC voltage. Accordingly, a suitable pulsating DC voltage source could be utilized for certain applications in the place of an AC voltage wave form as described herein.

Figure 7:
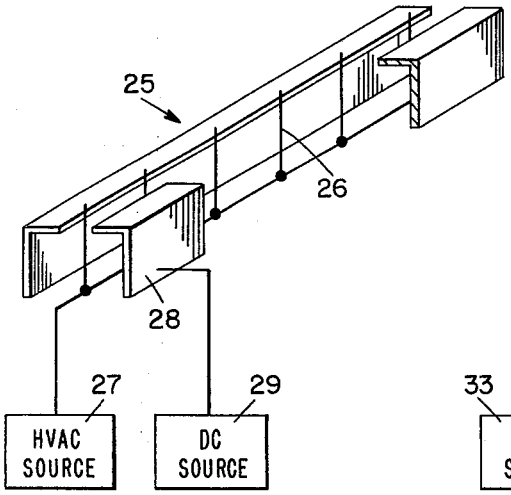
FIGS. 7 and 8 illustrate alternative embodiments for controlling static in accordance with the principles of this invention.

The balance and magnitude of the directional conductivity of the ionized field can be controlled in a number of different ways. It can be controlled, for example, by applying an output on line 24 to the ionizer member 10 in FIG. 1 using a wave form having a predetermined energy balance. Similarly, the ionized field may be modified by applying an AC voltage to the ionizer member 10 and applying a DC bias or pulsating DC voltage to the ground reference 15 of FIG. 1. For example, in FIG. 7 there is shown an ionizer member generally designated as 25 having a plurality of emitter pins 26 connected to a high voltage AC source 27. The emitter pins 26 are positioned within a shield 28 connected to a DC source 29 which may be either a high or low voltage DC source as desired. The balance and magnitude of the directional conductivity of the ionized field is controlled by the magnitude of the high voltage output produced by the high voltage AC source 27 and the polarity and magnitude of the output applied to the shield 28 from the DC source 29.

Figure 8:
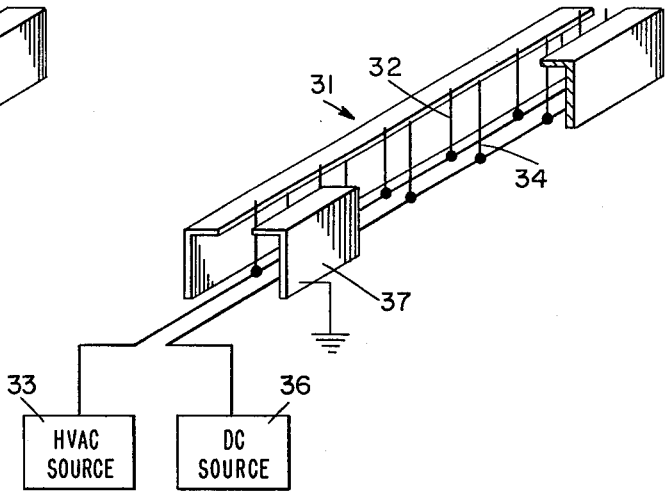

Additionally, the ionized field may be controlled by applying an AC voltage to some of the emitter points and applying a DC bias or pulsating DC voltage to other emitter points in the same ionized field. For example, FIG. 8 illustrates an ionizer member generally designated as 31 having one row of emitter pins 32 connected to a high voltage AC source 33 and another row of emitter pins 34 connected to a DC voltage source 36. The emitter pins 32 and 34 are positioned within a shield 37 connected to ground which provides the ground plane reference. The balance and magnitude of the directional conductivity of the ionized field produced by the ionizer member 31 is determined by the magnitude of the high voltage AC 31 and the polarity and magnitude of the DC voltage from source 36.

Figure 9:
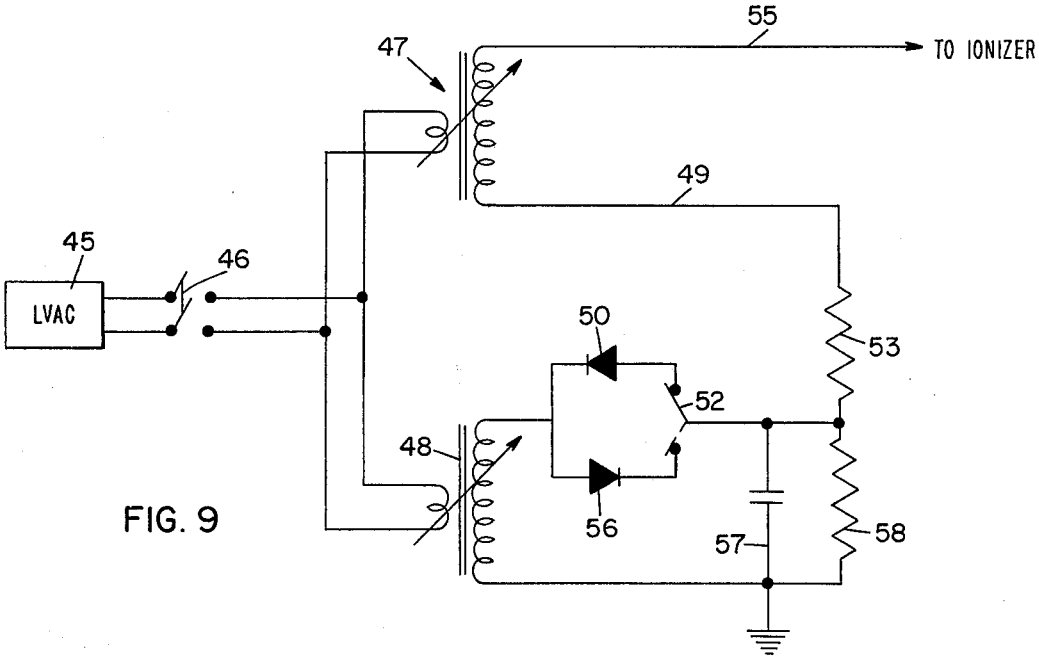
FIG. 9 is an electrical schematic of a high voltage DC biased AC power supply in accordance with the principles of this invention.

Referring now to FIG. 9, there is illustrated a circuit that can be utilized as the power source and control circuit 11 shown in FIG. 1. The circuit includes a low voltage AC source 45 connected through a switch 46 to two variable transformers 47 and 48. Variable transformer 47 steps up the low voltage AC. Variable transformer 48 steps up the low voltage AC and, depending on the position of switch 52, applies a DC output through line 49 of a selected polarity to the low voltage side of the secondary windings of the transformer 47. When switch 52 is in the position shown, diode 50 is connected into the circuit to produce a negative DC voltage through current limiter 53 on line 49 resulting in a negative biased high voltage AC output on line 55. The wave form of such an output will have a negative energy balance, thereby imposing a negative static charge on a moving film. When switch 52 is connected as shown by the dotted lines in FIG. 9, diode 56 is connected into the circuit to produce a positive DC output through current limiter 53 to line 49 to produce a positively biased high voltage AC output on line 55. Capacitor 57 functions to smooth the pulsating DC output from the diodes 50 and 56. Resistor 58 stabilizes the high voltage output by loading the circuit. The current limiter 53 is in the circuit to limit the current of the DC output on line 49 for safety purposes. By appropriate adjustment of variable transformers 47 and 48 and selection of switch 52, control over the high voltage AC output on line 55 to the ionizer member can easily be attained, thereby effecting the desired balance and control over the directional conductivity of the ionized field.

Figure 10:
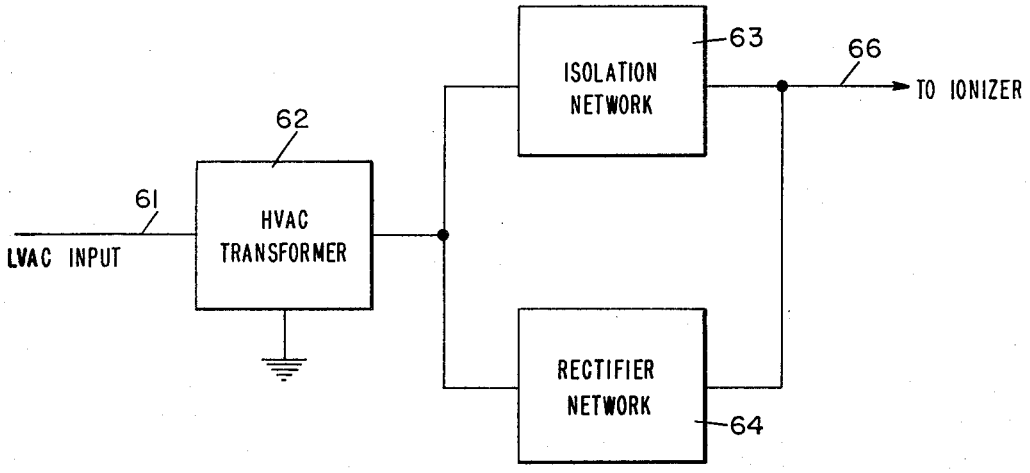
FIGS. 10 and 11 are block diagrams of alternative embodiments of the power source and control circuit of FIG. 1.

Referring now to FIG. 10, there is shown a block diagram of a circuit utilizing only the one transformer for economic purposes as opposed to two. The circuit includes a line 61 connected to a low voltage AC source which is in turn connected to a high voltage AC transformer 62. The output from the transformer 62 is applied to an isolation network 63 and a rectifier network 64. Isolation network 63 provides sufficient transformer isolation to allow the rectifier network to apply DC bias to the AC wave form which passes through the isolation network 63. The resultant output on line 66 is a DC biased high voltage AC output as previously described.

Figure 11:
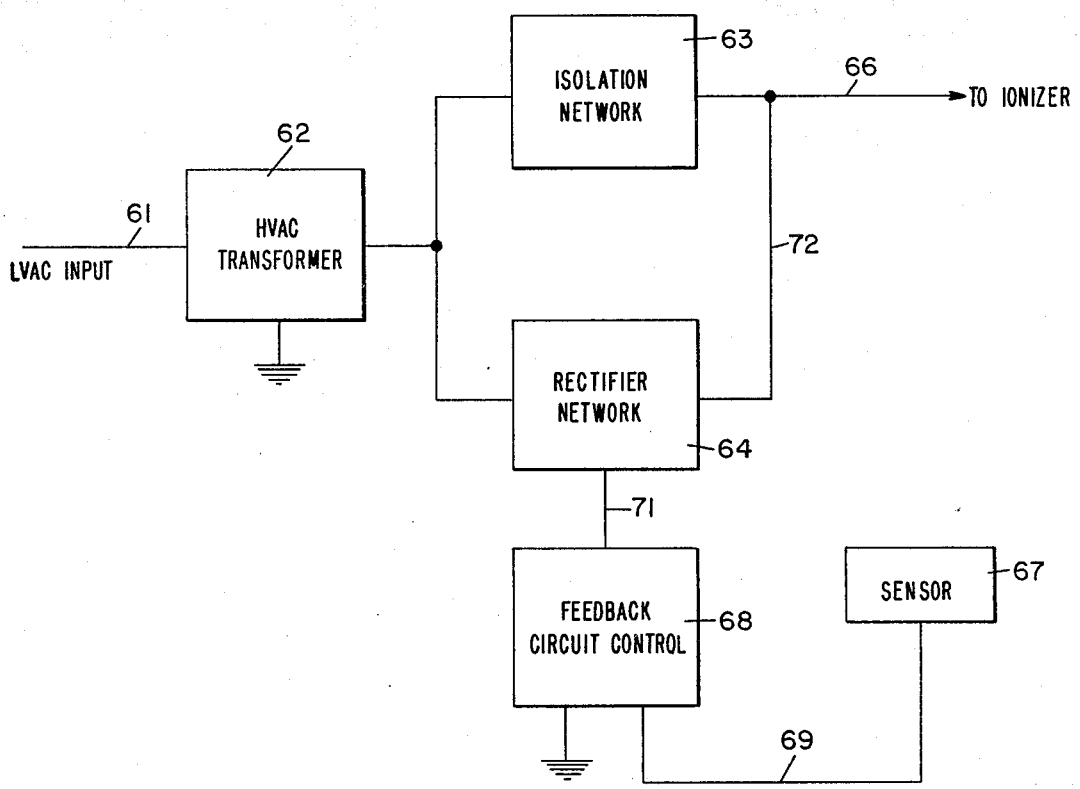

Referring now to FIG. 11, there is shown the block diagram of FIG. 10 incorporating a sensor 67 for sensing the static characteristics of the film after it passes through the ionized field and a feedback control circuit 68 for controlling the ionized field based upon the information detected by the sensor 67. The sensor 67 is positioned downstream from the ionizer adjacent to the film to detect the polarity and magnitude of any static charges on the film. The magnitude and charge on the film is fed back to the feedback control circuit 68 through line 69. Based upon the input to the feedback control circuit 68, an output 71 is generated to automatically adjust or control the rectifier network 64 and change the DC bias applied through line 72, thereby changing the resultant DC biased high voltage AC output on line 66 which is applied to the ionizer. Static sensors of the type described with respect to sensor 67 are commercially available. Automatic feedback control circuits such as that described with respect to circuit 68 are well known to those skilled in the art.

While we have described the AC voltage with reference to a sine wave, the AC voltage could also be a square wave as well. Additionally, although no mention has been made of frequency, the invention is applicable to any practical frequency that can be utilized. Furthermore, while the control of ion fields has been described herein primarily with respect to static control, it is to be understood that the control of the balance and directional conductivity of the ion field as described herein is applicable to situations other than static control having ion fields. For example, and without limitation, this invention can be used in any application which employs ionized fields, such as electrostatic or welding processes.

It is to be understood that the above described embodiments are merely illustrative of applications of the principles of this invention and that numerous other arrangements and modifications may be made within the spirit and scope of the invention.

What I claim and desire to protect by Letters Patent is:

1. Apparatus for controlling static charges on dielectric material comprising:

an ionizing member; and power source and control means for applying sufficient AC high voltage to said ionizing member for producing an ionized field and for controlling the balance and magnitude of the directional conductivity of the ionized field to impart static charges of predetermined magnitude and polarity to said material, said ionizied field being spaced from said ionizing member such that the dielectric material can be freely moved therethrough in contact only with the ionized field;

wherein said ionizing member includes a first array of interconnected emitter points and a second array of interconnected emitter points positioned adjacent to said first array, said first and second arrays partially surrounded by a grounded shield, and wherein AC high voltage is applied to said first array of emitter points and said power source and control means includes means for applying a DC voltage of predetermined magnitude and polarity to said second array.

* * * * *